US009353613B2

(12) United States Patent
Soliman et al.

(10) Patent No.: US 9,353,613 B2
(45) Date of Patent: May 31, 2016

(54) DISTRIBUTING A WELLBORE FLUID THROUGH A WELLBORE

(71) Applicant: Halliburton Energy Services, Inc., Houston, TX (US)

(72) Inventors: Mohamed Y. Soliman, Lubbock, TX (US); Freddy E. Crespo, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 432 days.

(21) Appl. No.: 13/766,479

(22) Filed: Feb. 13, 2013

(65) Prior Publication Data

US 2014/0224493 A1 Aug. 14, 2014

(51) Int. Cl.

| | |
|---|---|
| ***E21B 43/267*** | (2006.01) |
| ***E21B 43/26*** | (2006.01) |
| ***E21B 21/06*** | (2006.01) |

(52) U.S. Cl.

CPC ..... *E21B 43/267* (2013.01); *E21B 21/062* (2013.01)

(58) Field of Classification Search

CPC ... E21B 43/247; E21B 43/2405; E21B 43/26; E21B 43/267; E21B 21/062

USPC ..... 166/280.2, 308.1, 272.2

See application file for complete search history.

(56) References Cited

U.S. PATENT DOCUMENTS

| | | | | |
|---|---|---|---|---|
| 5,411,091 | A | 5/1995 | Jennings, Jr. | |
| 5,515,920 | A * | 5/1996 | Luk et al. | 166/280.1 |
| 6,776,235 | B1 | 8/2004 | England | |
| 2007/0204991 | A1 * | 9/2007 | Loree et al. | 166/280.1 |
| 2008/0271889 | A1 | 11/2008 | Misselbrook et al. | |
| 2009/0107674 | A1 | 4/2009 | Brannon et al. | |
| 2010/0038077 | A1 * | 2/2010 | Heilman et al. | 166/250.01 |
| 2011/0202275 | A1 * | 8/2011 | Beisel et al. | 702/6 |
| 2011/0278064 | A1 * | 11/2011 | Rasheed | E21B 10/32 175/24 |
| 2012/0048557 | A1 * | 3/2012 | Hughes et al. | 166/308.1 |
| 2012/0132421 | A1 | 5/2012 | Loiseau et al. | |
| 2013/0123152 | A1 * | 5/2013 | Stephens et al. | 507/269 |

FOREIGN PATENT DOCUMENTS

| | | |
|---|---|---|
| WO | WO2012072981 | 6/2012 |

OTHER PUBLICATIONS

Authorized Officer Chan Yoon Hwang, PCT International Search Report and Written Opinion, PCT/US2014/015888, May 9, 2014, 10 pages.

(Continued)

*Primary Examiner* — Kenneth L Thompson

*Assistant Examiner* — Michael Wills, III

(74) *Attorney, Agent, or Firm* — Craig W. Roddy; Fish & Richardson P.C.

(57) ABSTRACT

A method includes preparing a hydraulic fracturing fluid that includes a proppant mixture; adjusting the hydraulic fracturing fluid to a flow pattern operable to distribute a substantially equal distribution of an amount of proppant from the proppant mixture into a plurality of fracture clusters formed in a subterranean zone; and distributing the hydraulic fracturing fluid in the substantially equal distribution of the amount of proppant from the proppant mixture into the plurality of fracture clusters, each of the plurality of fracture clusters formed in the subterranean zone at a unique depth from the terranean surface.

18 Claims, 5 Drawing Sheets

(56) References Cited

OTHER PUBLICATIONS

Daneshy, Ali, "Shale Energy/Fracturing Uneven distribution of proppants in perf clusters," World Oil Online, Mar. 20, 2012, 5 pages.

Daneshy, Ali, "Shale Energy/Fracturing Multistage fracturing using plug-and-perf systems," World Oil Online, Mar. 6, 2012, 8 pages.

PCT International Preliminary Report on Patentability, PCT/US2014/015888, Aug. 27, 2015, 7 pages.

* cited by examiner

DISTRIBUTING A WELLBORE FLUID THROUGH A WELLBORE

TECHNICAL BACKGROUND

This disclosure relates to distributing a wellbore fluid through a wellbore.

BACKGROUND

Hydraulic fracturing may be used to increase production of hydrocarbons (e.g., oil, gas, and/or a combination thereof) from one or more subterranean zones. In some cases, a hydraulic fracturing operation consists of a "multi-stage" fracturing operation; in other cases, the hydraulic fracturing operation may consist of a "one-by-one" fracturing operation. In a one-by-one fracturing operation, individual portions of the subterranean zone(s) are isolated, possibly perforated, and then a single hydraulic fracturing operation is completed for the individual portion. This can be repeated depending on the number of portions of the zone to be fractured. In a multi-stage operation, in contrast, a much larger portion (e.g., a longer section of wellbore) is isolated within a zone or zones. Multiple clusters of perforations may be made and then each cluster is simultaneously fractured. While the one-by-one operation may allow an operator more control and provide for better (e.g., more) usable fractures within a subterranean zone, it may also be more time consuming and expensive. Although the multi-stage operation may be quicker and cheaper compared to the one-by-one operations, less usable fractures may be created in the subterranean zone.

DETAILED DESCRIPTION

Figure 1:
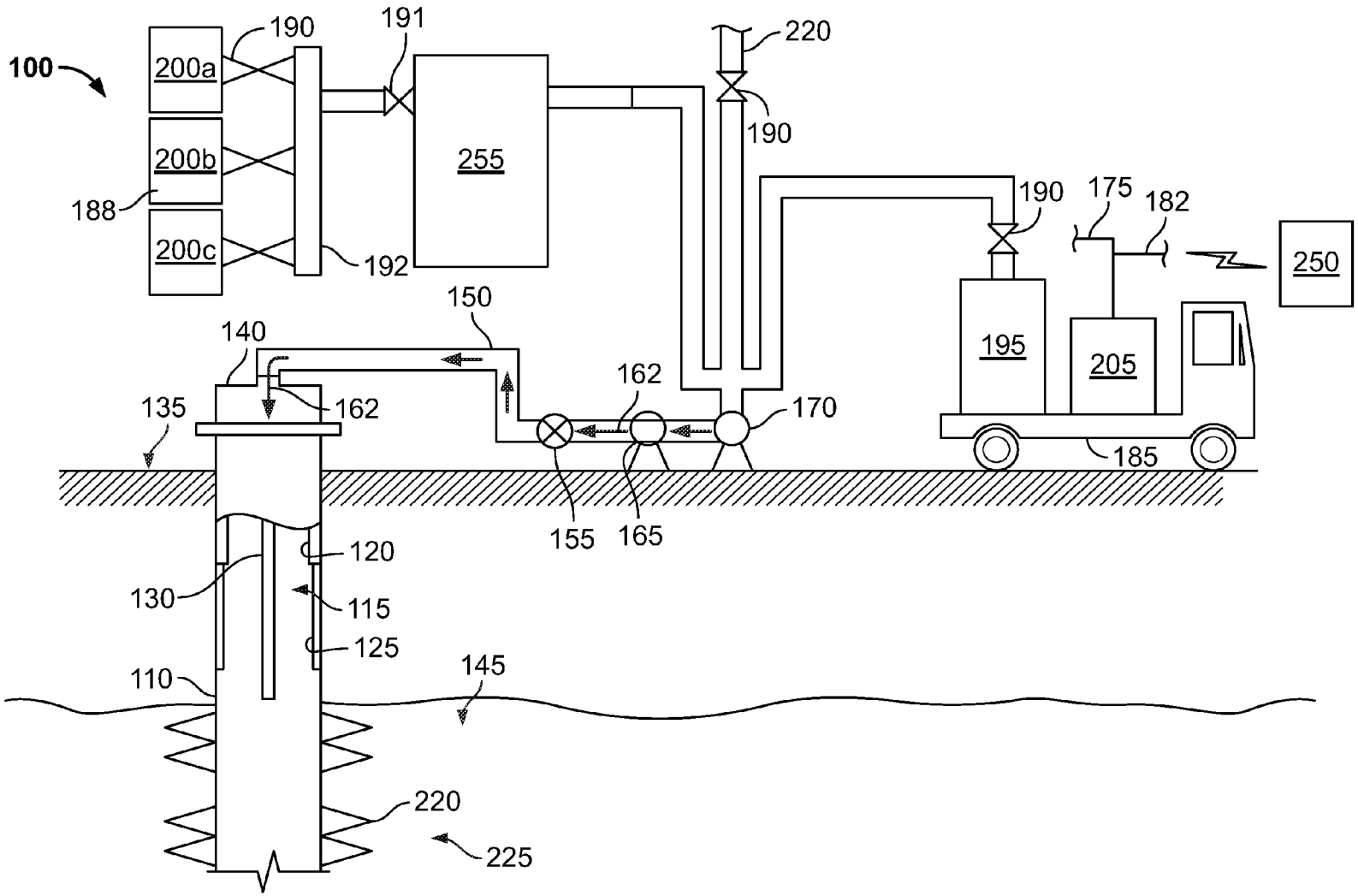
FIG. 1 illustrates an example implementation of at least a portion of a wellsite assembly in the context of a downhole operation (e.g., a fracturing operation)

In one general implementation according to the present disclosure, a method includes preparing a hydraulic fracturing fluid that includes a proppant mixture; adjusting the hydraulic fracturing fluid to a flow pattern operable to distribute a substantially equal distribution of an amount of proppant from the proppant mixture into a plurality of fracture clusters formed in a subterranean zone; and distributing the hydraulic fracturing fluid in the substantially equal distribution of the amount of proppant from the proppant mixture into the plurality of fracture clusters, each of the plurality of fracture clusters formed in the subterranean zone at a unique depth from the terranean surface.

In a first aspect combinable with the general implementation, adjusting the hydraulic fracturing fluid to a flow pattern operable to distribute a substantially equal distribution of an amount of proppant from the proppant mixture into a plurality of fracture clusters formed in a subterranean zone includes selecting a first proppant material and a second proppant material based on their respective specific gravities; and preparing the proppant mixture by mixing the first proppant material and the second proppant material.

In a second aspect combinable with any of the previous aspects, the first proppant material includes a first specific gravity and the second proppant material includes a second specific gravity that is different than the first specific gravity.

In a third aspect combinable with any of the previous aspects, distributing the hydraulic fracturing fluid through the wellbore includes distributing the hydraulic fracturing fluid for use in a multiple-stage fracturing treatment of the subterranean zone.

In a fourth aspect combinable with any of the previous aspects, preparing the proppant mixture by mixing the first proppant material and the second proppant material includes: dynamically preparing the proppant mixture at a wellsite during preparation of the hydraulic fracturing fluid for a hydraulic fracturing operation; and adjusting a ratio of the first and second proppant materials in the proppant mixture based on the hydraulic fracturing operation.

In a fifth aspect combinable with any of the previous aspects, selecting a first proppant material and a second proppant material based on their respective specific gravities includes selecting the first proppant material based on a first specific gravity that is greater than one; and selecting the second proppant material based on a second specific gravity that is greater than the first specific gravity.

In a sixth aspect combinable with any of the previous aspects, distributing the hydraulic fracturing fluid in the substantially equal distribution of the amount of proppant from the proppant mixture into the plurality of fracture clusters includes distributing the hydraulic fracturing fluid in the substantially equal distribution of the amount of proppant from the proppant mixture into the plurality of fracture clusters that is more uniform than a distribution into the plurality of fracture clusters produced by another hydraulic fracturing fluid that includes only one of the first proppant material or the second proppant material.

A seventh aspect combinable with any of the previous aspects further includes distributing the hydraulic fracturing fluid into a wellbore that includes a substantially horizontal portion.

In an eighth aspect combinable with any of the previous aspects, distributing the hydraulic fracturing fluid into a wellbore includes distributing the hydraulic fracturing fluid in a substantially laminar flow pattern into the wellbore.

In a ninth aspect combinable with any of the previous aspects, adjusting the hydraulic fracturing fluid to a flow pattern operable to distribute a substantially equal distribution of an amount of proppant from the proppant mixture into a plurality of fracture clusters formed in a subterranean zone includes distributing the hydraulic fracturing fluid through a flow restriction to generate a turbulent flow of the hydraulic fracturing fluid prior to distributing the hydraulic fracturing fluid to the plurality of fracture clusters.

In a tenth aspect combinable with any of the previous aspects, the proppant mixture includes a single type of proppant material having a substantially uniform specific gravity.

An eleventh aspect combinable with any of the previous aspects further includes distributing the turbulent flow of the hydraulic fracturing fluid into the subterranean zone from a wellbore.

In a twelfth aspect combinable with any of the previous aspects, distributing the hydraulic fracturing fluid through a flow restriction includes at least one of distributing hydraulic fracturing fluid through a nozzle or blender; distributing hydraulic fracturing fluid through a tortious flow path; or distributing hydraulic fracturing fluid along a flow path configured to produce eddy currents.

In another general implementation, a hydraulic fracturing system includes a proppant material source that includes a proppant material, the proppant material having a specific gravity; a hydraulic fracturing fluid source; a mixing assembly fluidly coupled to the proppant source and to a hydraulic fracturing fluid source; and a hydraulic fracturing assembly, coupled with the mixing assembly, that includes a pump to circulate a mixture of the proppant source and the hydraulic fracturing fluid source in a fracture treatment that includes a substantially equal distribution of an amount of proppant material into a plurality of fracture clusters formed in a subterranean zone, each of the plurality of fracture clusters formed in the subterranean zone at a unique depth from the terranean surface.

In a first aspect combinable with the general implementation, the proppant material source includes a first proppant material source, the proppant material includes a first proppant material, and the specific gravity includes a first specific gravity.

A second aspect combinable with any of the previous aspects further includes a second proppant material source that includes a second proppant material, the second proppant material having a second specific gravity different than the first specific gravity; and a proppant mixture source that includes a specified mixture of the first and second proppant materials.

In a third aspect combinable with any of the previous aspects, the first proppant material includes a first specific gravity and the second proppant material includes a second specific gravity that is different than the first specific gravity.

In a fourth aspect combinable with any of the previous aspects, the fracture treatment includes a multiple-stage fracturing treatment of the subterranean zone.

A fifth aspect combinable with any of the previous aspects further includes one or more flow control devices in fluid communication with the first and second proppant material sources.

A sixth aspect combinable with any of the previous aspects further includes one or more flow control devices fluidly coupled to the first and second proppant material sources and the mixing assembly; and a control system communicably coupled to the one or more flow control devices and configured to dynamically adjust the one or more flow control devices to adjust a ratio of the first and second proppant materials circulated to the mixing assembly.

In a seventh aspect combinable with any of the previous aspects, the first specific gravity is greater than one, and the second specific gravity is greater than the first specific gravity.

In an eighth aspect combinable with any of the previous aspects, the fracture treatment includes a substantially laminar flow of the hydraulic fracturing fluid.

A ninth aspect combinable with any of the previous aspects further includes a flow restriction in fluid communication with the hydraulic fracturing assembly, the fluid restriction adapted to generate a turbulent flow of the hydraulic fracturing fluid to provide the substantially equal distribution of the amount of proppant material into the plurality of fracture clusters formed in the subterranean zone.

In a tenth aspect combinable with any of the previous aspects, the proppant material includes a single type of proppant material having a substantially uniform specific gravity.

In an eleventh aspect combinable with any of the previous aspects, the flow restriction includes at least one of a nozzle or blender; a tortious flow path; or a flow path configured to produce eddy currents.

In another general implementation, a hydraulic fracturing method includes preparing a hydraulic fracturing fluid that includes a proppant mixture; preparing a multi-stage hydraulic fracture treatment with the hydraulic fracturing fluid; circulating the hydraulic fracturing fluid through a directional wellbore in a specified flow pattern; forming a plurality of hydraulic fractures in a subterranean zone at two or more distinct depths in the subterranean zone; and circulating a substantially uniform distribution of an amount of the proppant mixture to the plurality of hydraulic fractures based on the specified flow pattern.

In a first aspect combinable with the general implementation, the specified flow pattern includes a laminar flow pattern, and the proppant mixture includes two or more distinct proppant materials, each distinct proppant material including a specified specific gravity.

In a second aspect combinable with any of the previous aspects, the laminar flow pattern includes a first proppant material substantially uniformly distributed adjacent an outer surface of the laminar flow pattern, including a first specific gravity; and a second proppant material substantially uniformly distributed between the first proppant material distribution and a centerline of the laminar flow pattern, the second proppant material including a second specific gravity different than the first specific gravity.

In a third aspect combinable with any of the previous aspects, the first specific gravity is less than the second specific gravity.

In a fourth aspect combinable with any of the previous aspects, the specified flow pattern includes a turbulent flow pattern, and the proppant mixture includes only one proppant material that includes a substantially uniform specific gravity.

Various implementations of systems, method, and apparatus that implement techniques for distributing a wellbore fluid through a wellbore in accordance with the present disclosure may include none, one, some, or all of the following features. For example, uniform (or even) distribution of additives (e.g., proppant) in a wellbore fluid, such as a fracturing fluid (or gel), among fracture clusters in a multi-stage fracture treatment may be achieved. For instance, fracture clusters at every perforation within a number of perforations (or most of the perforations) may receive an approximately equal amount of proppant (e.g., by volume, by weight, by quantity, or otherwise). As another example, a substantially even distribution of proppant to fractures may occur by selectively combining proppants of different characteristics (e.g., weight, specific gravity, density, or otherwise) into a single flow of fracturing fluid. Further, a substantially even distribution of proppant to fractures may occur by turbilizing a flow of fracturing fluid that is circulated to the fracture clusters.

The details of one or more implementations of the subject matter of this specification are set forth in the accompanying drawings and the description below. Other features, aspects, and advantages of the subject matter will become apparent from the description, the drawings, and the claims.

FIG. 1 illustrates one implementation of at least a portion of a wellsite assembly 100 in the context of a downhole (e.g., fracturing) operation. A wellbore 110 is formed from a terranean surface 135 to and/or through a subterranean zone 145. The illustrated wellsite assembly 100 includes a tubing system 150 coupled to a flow restriction 155, a pump 165, a mixer 170, a liquid source 220; and a fracturing fluid truck 185 coupled to the tubing system 150. Although illustrated as onshore, the wellsite assembly 100 and/or wellbore 110 can alternatively be offshore or elsewhere. Further, although described in the context of a hydraulic fracturing operation, the wellsite assembly 100 may also illustrate another downhole operation that uses a fluid (e.g., a liquid, slurry, gel, or other fluid) such as an acidizing operation.

The wellbore 110, at least a portion of which is illustrated in FIG. 1, extends to and/or through one or more subterranean zones under the terranean surface 135, such as subterranean zone 145. Wellbore 110 may allow for production of one or more hydrocarbon fluids (e.g., oil, gas, a combination of oil and/or gas, or other fluid) from, for example, subterranean zone 145. The wellbore 110, in some aspects, is cased with one or more casings. As illustrated, the wellbore 110 includes a conductor casing 120, which extends from the terranean surface 135 shortly into the Earth. Other casing 125 is downhole of the conductor casing 120. Alternatively, some or all of the wellbore 110 can be provided without casing (e.g., open hole). Additionally, in some implementations, the wellbore 110 may deviate from vertical (e.g., a slant wellbore or horizontal wellbore) and/or be a multilateral wellbore.

A wellhead 140 is coupled to and substantially encloses the wellbore 110 at the terranean surface 135. For example, the wellhead 140 may be the surface termination of the wellbore 110 that incorporates and/or includes facilities for installing casing hangers during the well construction phase. The wellhead 140 may also incorporate one or more techniques for hanging tubing 130, installing one or more valves, spools and fittings to direct and control the flow of fluids into and/or from the wellbore 110, and installing surface flow-control facilities in preparation for the production phase of the wellsite assembly 110.

The tubing system 150 is coupled to the wellhead 140 and, as illustrated, provides a pathway through which one or more fluids, such as fluid 162, into the wellbore 110. In certain instances, the tubing system 150 is in fluid communication with the tubing 130 extending through the wellbore 110. The fluid 162, in the illustrated implementation of FIG. 1, is a fracturing fluid introduced into the wellbore 110 to generate one or more fractures in the subterranean zone 145.

In the implementation of FIG. 1 illustrating a hydraulic fracturing completion operation, the tubing system 150 is used to introduce the fluid 162 into the wellbore 110 via one or more portions of conduit and one or more flow control devices, such as the flow restriction 155, the pump 165, the mixer 170, one or more valves 190 (e.g., control, isolation, or otherwise), the liquid source 220, and the truck 185. Generally, the pump 165, the mixer 170, the liquid source 220, and the truck 185 are used to mix and pump a fracturing fluid (e.g., fluid 162) into the wellbore 110.

The well assembly 100 includes gel source 195 and solids source 200 (e.g., a proppant source). Either or both of the gel source 195 and solids source 200 could be provided on the truck 185. Although illustrated as a "truck," truck 185 may represent another vehicle-type (e.g., tractor-trailer or other vehicle) or a non-vehicle permanent or semi-permanent structure operable to transport and/or store the gel source 195 and/or solids source 200. Further, reference to truck 185 includes reference to multiple trucks and/or vehicles and/or multiple semi-permanent or permanent structures.

The gel from the gel source 195 is combined with a hydration fluid, such as water and/or another liquid from the liquid source 220, and additives (e.g., proppant) from a solids source 200 (shown as multiple sources in FIG. 1) in the mixer 170. Proppant, generally, may be particles mixed with fracturing fluid (such as the mixed gel source 195 and liquid source 220) to hold fractures open after a hydraulic fracturing treatment.

In some aspects, assembly 100 may include multiple solids sources 200*a* through 200*c*. As illustrated, the sources 200*a* through 200*c* may be coupled through valves 190 (e.g., control or modulating valves or otherwise) to a header 192 and thereby to a material source 255. Further, as shown, a main valve 191 (e.g., a shut-off valve or modulating valve or otherwise) fluid couples the material source 255 with a header connected to multiple solids sources 200*a*-200*c*. Although three solids sources 200*a*-200*c* are shown, more sources, less sources, or different sources of wellbore fluid additives may be included within the well assembly 100. Further, each solids source 200*a*, 200*b*, or 200*c* may enclose or hold different additives (e.g., proppants). For instance, proppants 188 of differing properties (e.g., specific gravity) may be enclosed in the sources 200*a*-200*c*. As another example, multiple sources 200*a*, 200*b*, and/or 200*c* may contain the same additive. Thus, the contents of the solids sources 200*a*-200*c* may be supplied as a uniform (e.g., single) proppant 188 for the wellbore fluid 162 or in varying ratios of two or more proppants 188 from multiple sources 200*a*-200*c*.

In some examples, the solids sources 200*a*-200*c* may hold or contain a wellbore additive, such as a proppant 188. Generally, the proppant 188 may comprise particles that, when mixed with a wellbore fluid, such as a hydraulic fracturing fluid, and distributed into fractures, hold the fractures open after a hydraulic fracturing treatment. Proppant 188 may include, for example, naturally occurring sand grains, man-made or specially engineered particles, such as resin-coated sand or ceramic materials like sintered bauxite. Proppant 188 may be selected or specified according to one or more properties, such as, for instance, size, sphericity, density, specific gravity, or otherwise, to provide a path for production of fluid from the subterranean zone 145 to the wellbore 110.

As illustrated, the flow restriction 155 is positioned in the tubing system 150 that supplies wellbore fluid 162 (e.g., a hydraulic fracturing fluid) to the wellbore 110. The wellbore fluid 162 that flows through the flow restriction 155 may contain one or more of the additives stored in the solids sources 200*a*-200*c*, as described above. In some examples, the flow restriction 155 may simply be a shut-off valve that binarily controls a flow of the wellbore fluid 162 through the tubing 150 without imparting any (or imparting little) turbulence to the wellbore fluid 162. For example, the flow restriction 155 may be chosen so that a flow pattern of the wellbore fluid 162 through the tubing 150 may be laminar or substantially laminar.

In another aspect, the flow restriction 155 may be chosen to impart turbulence to the wellbore fluid 162. For example, the flow restriction 155 may be a valve, nozzle, venture, section of the tubing 150 that includes a twisting or tortuous path, or otherwise. For example, the flow restriction 155 may include a portion of the tubing 150 that induces eddy currents in a flow of the wellbore fluid 162.

Notably, although the concepts described herein are discussed in connection with a hydraulic fracturing operation, they could be applied to other types of operations. For example, the wellsite assembly could be that of a cementing operation where a cementing mixture (Portland cement, polymer resin, and/or other cementing mixture) may be injected into wellbore 110 to anchor a casing, such as conductor casing 120 and/or surface casing 125, within the wellbore 110. In this situation, the fluid 162 could be the cementing mixture. In another example, the wellsite assembly could be that of a drilling operation, including a managed pressure drilling operation. In another example, the wellsite assembly could be that of a stimulation operation, including an acid treatment. Still other examples exist.

The wellsite assembly 100 also includes computing environment 250 that may be located at the wellsite (e.g., at or near the truck 205) or remote from the wellsite. Generally, the computing environment 250 may include a processor based computer or computers (e.g., desktop, laptop, server, mobile device, cell phone, or otherwise) that includes memory (e.g., magnetic, optical, RAM/ROM, removable, remote or local), a network interface (e.g., software/hardware based interface), and one or more input/output peripherals (e.g., display devices, keyboard, mouse, touchscreen, and others).

In certain implementations, the computing environment 250 may at least partially control, manage, and execute operations associated with managing distribution of the wellbore fluid 162 through the wellbore 110. For example, in some aspects, the computing environment 250 may: control the valves 190 that, for example, modulate flows of proppants 188 from the solids sources 200*a*-200*c* to the material source 255, control valves 190 that modulate a flow of the liquid source 220 and/or the gel source 195, control one or more pumps such as pumps 165 and 170, and/or control the flow restriction 155 to manage or adjust an amount of turbulence imparted to the wellbore fluid 162, to name a few examples.

As another example, the computing environment 250 may control one or more of the illustrated components of well assembly 100 to, for example, optimize a proppant mixture based on size of proppant material (e.g., in solids sources 200*a*-200*c*), specific gravity of proppant material, or other proppant material property. For example, multiple proppants with varying specific gravities may be mixed (e.g., in material source 255) so as to form a stratified hydraulic fracturing fluid flow pattern (e.g., with respect to the various proppants) as described with reference to FIGS. 2A-2B.

In some aspects, the computing environment 250 may control one or more of the illustrated components of well assembly 100 dynamically, such as, in real-time during a fracturing operations at the wellsite assembly 100. For instance, the computing environment 250 may control one or more of the illustrated components to modify and/or adjust a mixture of the proppants stored in solids sources 200*a*-200*c* during the operation.

In the illustrated embodiment, the wellbore fluid 162 may be a hydraulic fracturing fluid that forms, e.g., due to pressure, hydraulic fractures 220 in the subterranean zone 145 (shown schematically in FIG. 1). In some aspects, the fractures 220 may increase a permeability of rock in the zone 145, thereby increasing, in some aspects, a flow of hydrocarbon fluids from the zone 145 to the wellbore 110. Fractures 220 may also include, in some aspects, naturally-occurring fractures in the rock of the zone 145. As illustrated, multiple fractures 220 may extend from multiple points of the wellbore 110 and in multiple fracture clusters 225 (e.g., sets of individual fractures 220).

In some examples, each fracture cluster 225 (of which there may be two, more than two, and even many multiple such as hundreds) may be formed, e.g., by a fracture treatment that include pumping the wellbore fluid 162 into the zone 145, at many different levels within the wellbore 145. For example, fracture clusters 225 may be formed at different, specified depths from the terranean surface 135 within the subterranean zone 145 or across multiple subterranean zones 145.

In some aspects, the fracture treatment that includes the wellbore fluid 162 may be a multi-stage treatment. For example, in the multi-stage treatment, a particular zone or length of the wellbore 110 (e.g., all or a portion of a horizontal part of the wellbore 110) may be hydraulically isolated within the wellbore 110 (e.g., with packers or other devices) and a single treatment of the wellbore fluid 162 may be applied to the isolated portion to form multiple fracture clusters 225. In some aspects, the formed fracture clusters 225 may be within a single zone 145 or multiple zones 145.

Figure 2B:
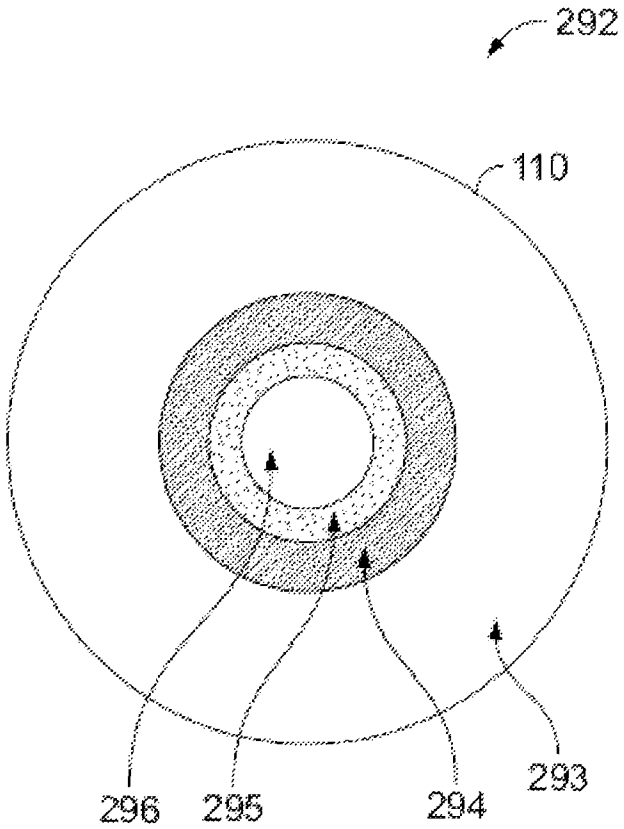
FIGS. 2A-2B illustrate example top views of flow patterns of wellbore fluid in a wellbore where the wellbore fluid contain one or more additives.
Figure 2A:
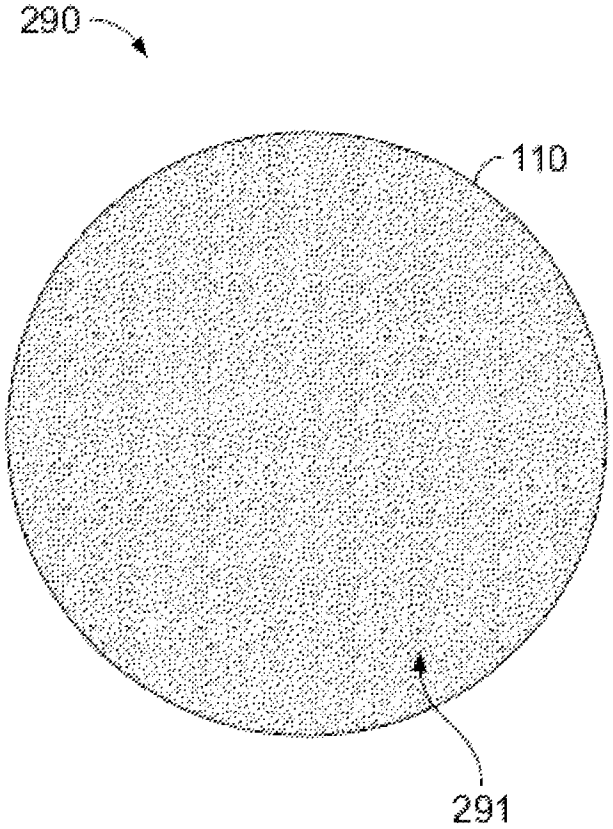

FIGS. 2A-2B illustrate example top schematic views 290 and 292, respectively, of flow patterns of wellbore fluid in a wellbore where the wellbore fluid contain one or more additives. As shown, FIGS. 2A-2B illustrates two views 290 and 292 of a wellbore 110. In a first top view 290 of FIG. 2A, the wellbore 110 is illustrated as showing a turbulent flow of a hydraulic fracturing fluid 291 that contains proppant. In some aspects, as described above, the turbulent flow of the fracturing fluid 291 may be generated, for example, by circulating the fracturing fluid 291 through a flow restriction, such as a nozzle, venturi, control valve, or other type of restriction that promotes a turbulent flow regime. As illustrated, the turbulent flow of the fracturing fluid 291 may evenly or uniformly (e.g., substantially) distribute proppant (illustrated as particles in the flow 291). In this example, the proppant in the fracturing fluid 291 may be substantially identical or similar and have a substantially similar set of properties, such as, for instance, specific gravity.

In some aspects, as a result of this even or uniform distribution, as the flow of the fluid 291 is distributed to fractures in a subterranean zone (e.g., fractures 220) or fracture clusters (e.g., 225), then a more uniform or even distribution of proppant may be delivered to the fractures or fracture clusters as compared to a flow of the fracturing fluid 291 (including proppant) that is at a relatively laminar flow regime. For instance, the turbulent flow of the fracturing fluid 291 may promote or help promote a more even or uniform distribution of proppant to fractures or fracture clusters.

In another view 292 of FIG. 2B, a wellbore 110 also encloses a flow of a hydraulic fracturing fluid that, in this example, is shown schematically separated according to proppant property into fracturing fluid flow patterns 293, 294, 295, and 296. In this example, the hydraulic fracturing fluid may be a substantially laminar flow regime that includes proppants of differing properties, such as specific gravity. Thus, in this example, the hydraulic fracturing fluid includes four proppant materials with each material having a different specific gravity. Each flow pattern 293, 294, 295, and 296, therefore, in this example, corresponds to a portion of the hydraulic fracturing fluid that is radially stratified based on the specific gravity of the proppants. In alternative aspects, however, there may be more or fewer different proppant materials, thereby forming more or fewer flow patterns.

In the illustrated example, proppants of higher specific gravities may gravitate towards a center of the hydraulic fracturing flow through the wellbore 110. Thus, the flow pattern 293 may include proppant with the lowest specific gravity relative to the proppants in the flow patterns 294, 295, and 296. The flow pattern 296 may include proppant with the highest specific gravity relative to the proppants in the flow patterns 293, 294, and 295. The flow patterns 294 and 295 may include proppants with specific gravities that are between the specific gravities of those proppants in flow patterns 293 and 296. Example proppants could include sand (e.g., with a specific gravity of 2.65), man-made proppants (e.g., with specific gravities greater than 2.65), light-weight proppants (e.g., with specific gravities of about 2.1), and otherwise.

In some aspects, the above-described stratification of proppants in the hydraulic fracturing fluid flow (e.g., flow patterns 293-296) may be due at least in part to different momentums of the proppants due to the different specific gravities of the proppants. The proppant particles with the highest specific gravities may move toward the center of the flow (e.g., towards the flow pattern 296) due to momentum. The closer the proppant material is to this center, the less proppant material may be distributed into fractures or fracture clusters, especially shallower fractures. On the other hand, proppant particles with the lowest specific gravities may move toward the outside of the flow (e.g., towards the flow pattern 293) as an effect of momentum diminishes. Proppant material in or at an outer edge of the flow in the wellbore 110 may more easily turn into fractures or fracture clusters than, for instance, proppant material near a center of the flow in the wellbore 110.

In a specific example, a particular mix of proppant materials may comprise three different proppant materials A, B, and C in substantially equal percentages (e.g., 33% each). Proppant A has a specific gravity of about 1.5, Proppant B has a specific gravity of about 2.0, and Proppant C has a specific gravity of about 3.2. In this example, Proppant A would flow to fractures or fracture clusters at or near an outer edge of a fracturing fluid flow (e.g., flow pattern 293), Proppant B would flow to fractures or fracture clusters in the middle of a fracturing fluid flow (e.g., flow pattern 294 or 295), and Proppant C would flow to fractures or fracture clusters at or near a center of a fracturing fluid flow (e.g., flow pattern 296). In this example, therefore, Proppant A may flow (e.g., within a fracturing fluid flow) to fractures or fracture clusters at a relatively shallow depth, Proppant B may flow (e.g., within a fracturing fluid flow) to fractures or fracture clusters at a relatively middle depth, and Proppant C may flow (e.g., within a fracturing fluid flow) to fractures or fracture clusters at a relatively deeper depth in the wellbore. In some aspects, an amount of total proppant distributed to the relatively shallow depth fractures, the relatively middle depth fractures, and the relatively deeper depth fractures may be substantially even or uniform.

Figure 3A:
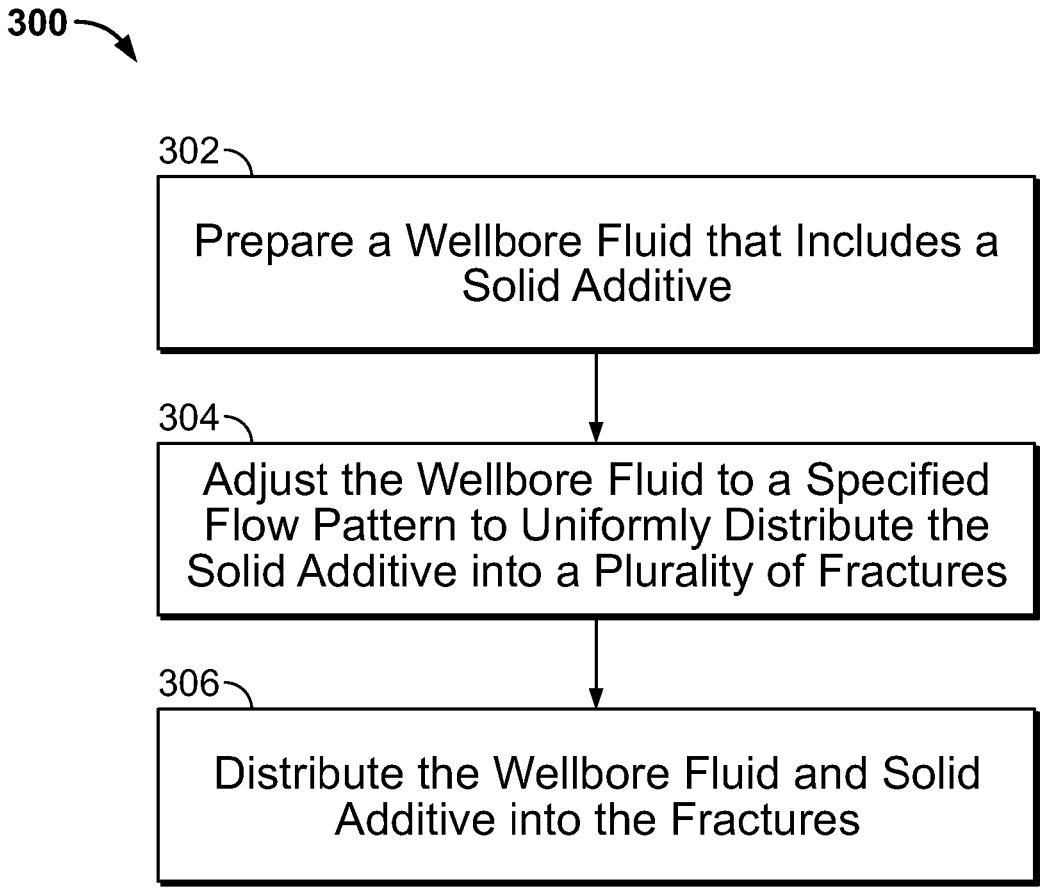
FIGS. 3A-3C illustrate flowcharts that describe example methods for distributing a wellbore fluid through a wellbore.
Figure 3B:
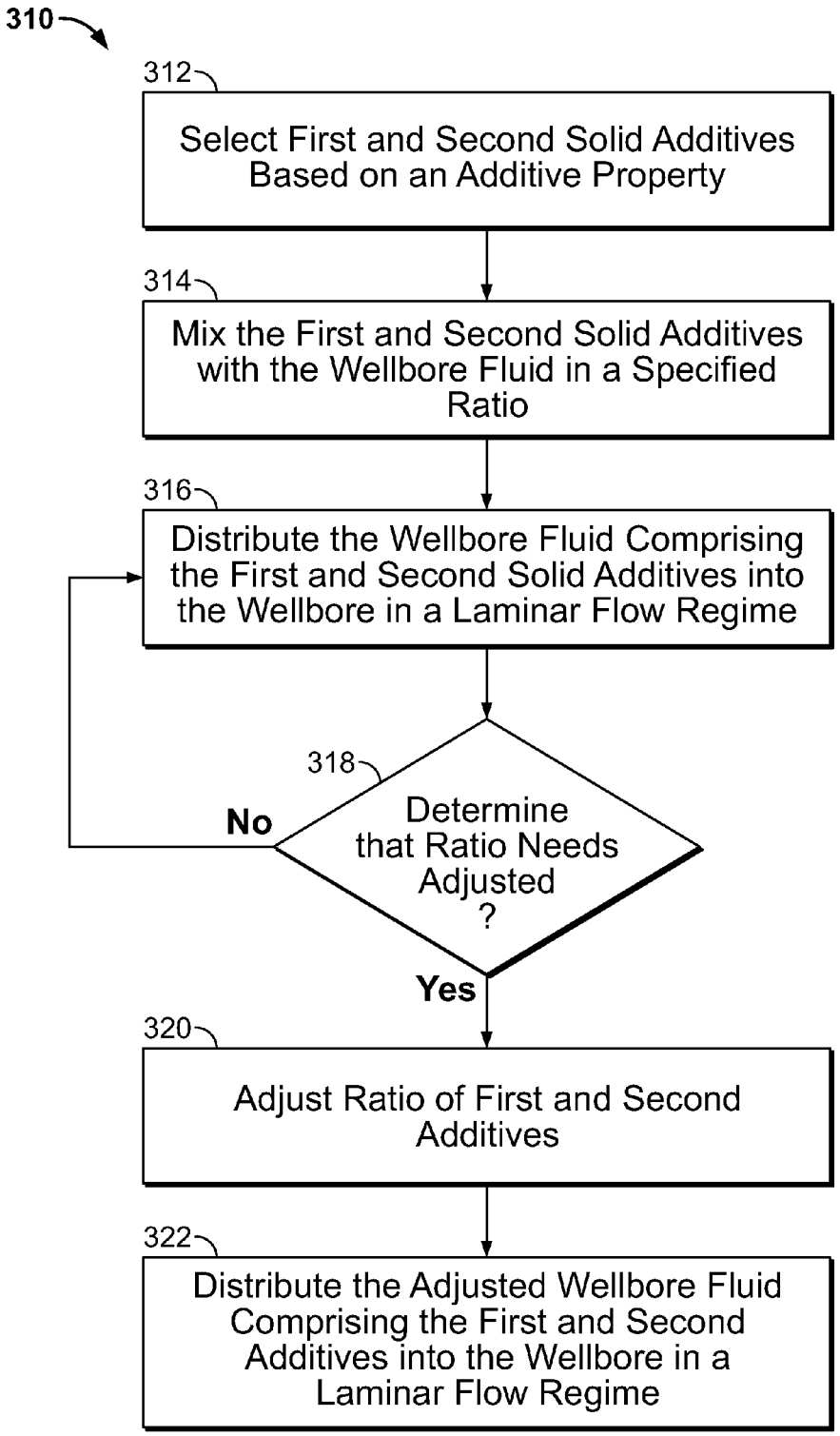

FIGS. 3A-3B illustrate flowcharts that describes example methods 300, 310, and 330 for distributing a wellbore fluid through a wellbore. In some aspects, methods 300, 310, and 330 may be performed with all or a portion of the wellsite assembly 100 or, in some other aspects, a wellsite assembly that is different than the wellsite assembly 100.

Method 300 in FIG. 3A may begin at step 302, when a wellbore fluid that includes a solid additive is prepared. For example, the wellbore additive may be a fracturing fluid and the solid additive may be one or more proppant materials. In some instances, the wellbore fluid and solid additive may be prepared at a wellsite before or during a wellbore operation (e.g., a hydraulic fracturing operation).

In step 304, the wellbore fluid may be adjusted to a specified flow pattern that provides for uniform or even (e.g., substantially or otherwise) distribution of the solid additive into a plurality of fractures (e.g., fractures or fracture clusters). In some aspects, the distribution of the solid additive into a plurality of fractures at the specified flow pattern may be more uniform or even as compared to a distribution of the solid additive into a plurality of fractures at another (or no particular) flow pattern.

In step 306, the wellbore fluid including the solid additive may be distributed into the fractures as the fractures are formed by the fluid at a high pressure. In some aspects, subsets of the fractures (e.g., clusters) may be formed at various depths in a subterranean zone 9 e.g., extending from the wellbore). The solid additives may be distributed substantially uniformly or evenly into the fractures at the various depths.

Turning to FIG. 3B, the method 310 may illustrate one example method for adjusting the wellbore fluid to the specified flow pattern (e.g., as shown in step 302). Method 310 may start at step 312, where first and second solid additives may be selected based on an additive property. For instance, in some aspects, as in the case of proppant additives, two or more proppants (e.g., in solids sources 200*a*-200*c*) may be selected based on material size, specific gravity, or other property. The selected proppant materials may have different values of the particular property. For example, in the case of specific gravity, each selected proppant material may have a different specific gravity.

In step 314, the first and second solid additives are mixed to form an additive mixture that is mixed with the wellbore fluid in a specified ratio. In some example, the solid additives, e.g., proppants, as well as the wellbore fluid, e.g., a base fluid and/or fracturing gel fluid, are mixed to form a hydraulic fracturing fluid at substantially the same time. In some examples, the specified ratio may be a ratio according to volume of the solid additives that forms a particular flow pattern of the hydraulic fracturing fluid when distributed into a wellbore.

In step 316, the wellbore fluid including the first and second solid additives are distributed into the wellbore in a laminar flow regime. In some examples, as described above, solid additives, e.g., proppants, with different properties, e.g., specific gravities, may, within a laminar flow regime, form a particular flow pattern such that proppant material with lower specific gravities may move toward an outer edge of the wellbore fluid flow while proppant material with higher specific gravities may move toward a center of the wellbore fluid flow.

In step 318, a determination is made as to whether the specified ratio should be adjusted. If that determination is made, then in step 320, the ratio is adjusted. For instance, in some examples, it may be determined, e.g., at a terranean surface, that particular fractures, such as fractures at greater depths in the subterranean zone, may not receive a sufficient amount of proppant material. In such cases, for example, the specified ratio may be adjusted dynamically by adding a proppant material with a higher specific gravity. In such instances, for example, proppant material with the higher specific gravity may be less inclined to flow to higher depth fractures, thereby providing more proppant material to flow to the greater depth fractures.

In step 322, the adjusted wellbore fluid including the first and second solid additives (e.g., at an adjusted ratio) are distributed into the wellbore in a laminar flow regime.

Figure 3C:
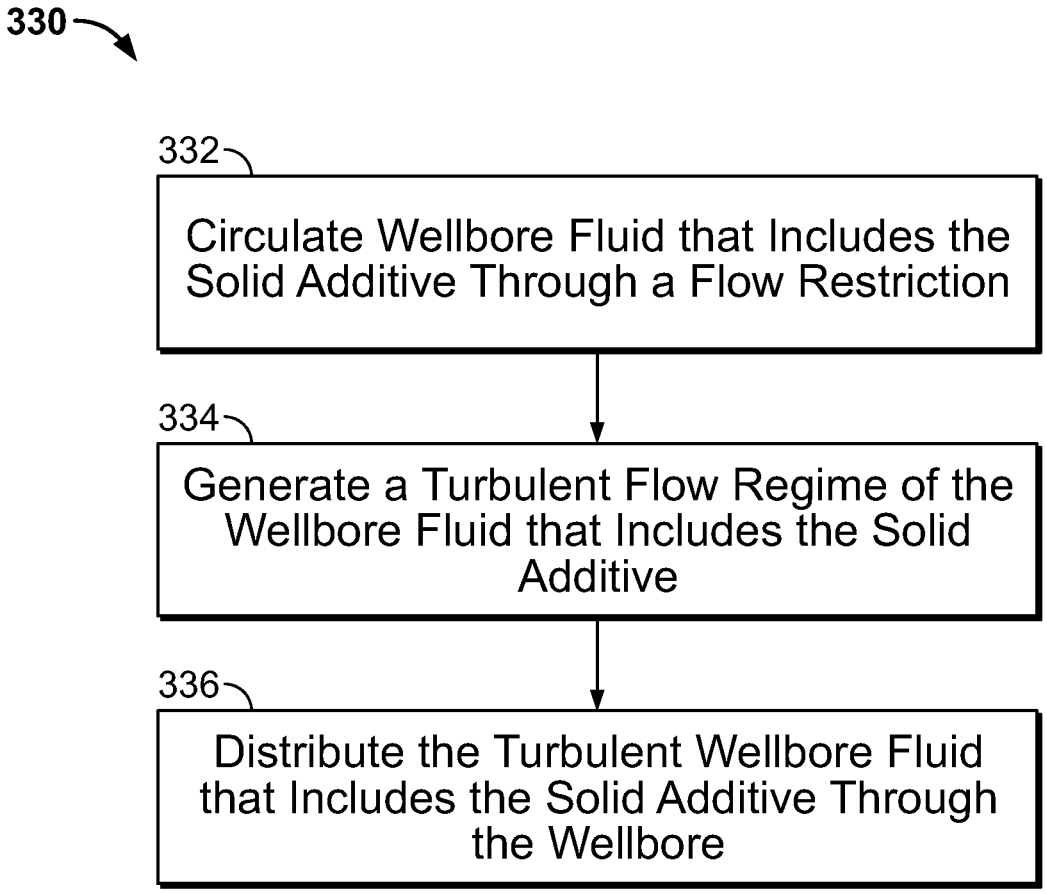

Turning to FIG. 3C, the method 330 may illustrate another example method for adjusting the wellbore fluid to the specified flow pattern (e.g., as shown in step 302). Method 330 may begin at step 332, when the wellbore fluid that includes the solid additive, e.g., proppant, is circulated through a flow restriction (e.g., flow restriction 155). The flow restriction may include a tortuous path or conduit, nozzle, venturi, or other restriction. In step 334, a flow pattern of a turbulent flow regime of the wellbore fluid, e.g., fracturing fluid, that includes the proppant is generated by the flow restriction. In step 336, the turbulent flow regime of the fracturing fluid that includes the proppant is distributed through the wellbore.

In some examples, method 330 may be performed when a single type of proppant, e.g., having a substantially constant specific gravity, size, or other property, is included within the hydraulic fracturing fluid. For example, in some aspects, the flow pattern of the turbulent flow regime may evenly or uniformly distribute the proppant to fractures or fracture clusters at various depths in a subterranean zone better than, for example, a flow pattern of a laminar (e.g., substantially or otherwise) flow regime that includes a single type of proppant material.

A number of implementations have been described. Nevertheless, it will be understood that various modifications may be made. For example, advantageous results may be achieved if the steps of the disclosed techniques were performed in a different sequence, if components in the disclosed systems were combined in a different manner, or if the components were replaced or supplemented by other components. Accordingly, other implementations are within the scope of the following claims.

What is claimed is:

1. A method comprising:

preparing a hydraulic fracturing fluid that comprises a proppant mixture;

adjusting the hydraulic fracturing fluid to a flow pattern operable to distribute a substantially equal distribution of an amount of proppant from the proppant mixture into a plurality of fracture clusters formed in a subterranean zone; and distributing the hydraulic fracturing fluid in the substantially equal distribution of the amount of proppant from the proppant mixture into the plurality of fracture clusters, each of the plurality of fracture clusters formed in the subterranean zone at a unique depth from a terranean surface;

wherein adjusting the hydraulic fracturing fluid comprises inducing a laminar flow regime in which proppant materials with lower specific gravities move toward an outer annulus of the flow pattern while proppant material with higher specific gravities move toward a center of the flow pattern.

2. The method of claim 1, wherein adjusting the hydraulic fracturing fluid to a flow pattern operable to distribute a substantially equal distribution of an amount of proppant from the proppant mixture into a plurality of fracture clusters formed in a subterranean zone comprises:

selecting a first proppant material and a second proppant material based on their respective specific gravities; and preparing the proppant mixture by mixing the first proppant material and the second proppant material.

3. The method of claim 2, wherein the first proppant material comprises a first specific gravity and the second proppant material comprises a second specific gravity that is different than the first specific gravity, and distributing the hydraulic fracturing fluid comprises distributing the hydraulic fracturing fluid for use in a multiple-stage fracturing treatment of the subterranean zone.

4. The method of claim 2, wherein preparing the proppant mixture by mixing the first proppant material and the second proppant material comprises:

dynamically preparing the proppant mixture at a wellsite during preparation of the hydraulic fracturing fluid for a hydraulic fracturing operation; and adjusting a ratio of the first and second proppant materials in the proppant mixture based on the hydraulic fracturing operation.

5. The method of claim 2, wherein selecting a first proppant material and a second proppant material based on their respective specific gravities comprises:

selecting the first proppant material based on a first specific gravity that is greater than one; and selecting the second proppant material based on a second specific gravity that is greater than the first specific gravity.

6. The method of claim 2, wherein distributing the hydraulic fracturing fluid in the substantially equal distribution of the amount of proppant from the proppant mixture into the plurality of fracture clusters comprises distributing the hydraulic fracturing fluid in the substantially equal distribution of the amount of proppant from the proppant mixture into the plurality of fracture clusters that is more uniform than a distribution into the plurality of fracture clusters produced by another hydraulic fracturing fluid that comprises only one of the first proppant material or the second proppant material.

7. The method of claim 1, wherein the hydraulic fracturing fluid comprises at least one of gel or liquid fluid, and the proppant mixture comprises solid proppant particles suspended in the fluid.

8. A hydraulic fracturing system, comprising:

a proppant material source that comprises a proppant material, the proppant material having a specific gravity;

a hydraulic fracturing fluid source;

a mixing assembly fluidly coupled to the proppant source and to the hydraulic fracturing fluid source;

a hydraulic fracturing assembly, coupled with the mixing assembly, that comprises a pump to circulate a mixture of the proppant source and the hydraulic fracturing fluid source in a fracture treatment that comprises a substantially equal distribution of an amount of proppant material into a plurality of fracture clusters formed in a subterranean zone, each of the plurality of fracture clusters formed in the subterranean zone at a unique depth from a terranean surface; and a flow control device to induce a laminar flow regime of the mixture in which proppant materials with lower specific gravities move toward an outer annulus of a flow pattern while proppant material with higher specific gravities move toward a center of the flow pattern.

9. The system of claim 8, wherein the proppant material source comprises a first proppant material source, the proppant material comprises a first proppant material, and the specific gravity comprises a first specific gravity, the system further comprising:

a second proppant material source that comprises a second proppant material, the second proppant material having a second specific gravity different than the first specific gravity; and a proppant mixture source that comprises a specified mixture of the first and second proppant materials.

10. The system of claim 9, wherein the hydraulic fracturing assembly is configured to perform a fracture treatment comprising a multiple-stage fracturing treatment of the subterranean zone.

11. The system of claim 9, further comprising:

one or more flow control devices fluidly coupled to the first and second proppant material sources and the mixing assembly; and a control system communicably coupled to the one or more flow control devices and configured to dynamically adjust the one or more flow control devices to adjust a ratio of the first and second proppant materials circulated to the mixing assembly.

12. The system of claim 9, wherein the first specific gravity is greater than one, and the second specific gravity is greater than the first specific gravity.

13. The system of claim 8, wherein the hydraulic fracturing fluid source comprises at least one of gel or liquid fluid source, and the mixture comprises solid proppant particles suspended in the fluid.

14. A hydraulic fracturing method, comprising:

preparing a hydraulic fracturing fluid that comprises a proppant mixture;

preparing a multi-stage hydraulic fracture treatment with the hydraulic fracturing fluid;

circulating the hydraulic fracturing fluid through a directional wellbore in a specified flow pattern;

forming a plurality of hydraulic fractures in a subterranean zone at two or more distinct depths in the subterranean zone; and circulating a substantially uniform distribution of an amount of the proppant mixture to the plurality of hydraulic fractures based on the specified flow pattern;

wherein circulating the hydraulic fracturing fluid comprises inducing a laminar flow regime in which proppant materials with lower specific gravities move toward an outer annulus of the wellbore while proppant material with higher specific gravities move toward a center of the wellbore.

15. The hydraulic fracturing method of claim 14, wherein the specified flow pattern comprises a laminar flow pattern formed by the induced laminar flow regime, and the proppant mixture comprises two or more distinct proppant materials, each distinct proppant material comprising a specified specific gravity.

16. The hydraulic fracturing method of claim 15, wherein the laminar flow pattern comprises:

a first proppant material substantially uniformly distributed adjacent an outer surface of the laminar flow pattern, comprising a first specific gravity; and a second proppant material substantially uniformly distributed between the first proppant material distribution and a centerline of the laminar flow pattern, the second proppant material comprising a second specific gravity different than the first specific gravity.

17. The method of claim 14, wherein the hydraulic fracturing fluid comprises at least one of gel or liquid fluid, and the proppant mixture comprises solid proppant particles suspended in the fluid.

18. A method comprising:

selecting a first proppant material and a second proppant material based on their respective specific gravities, the first proppant material comprising a first specific gravity and the second proppant material comprising a second specific gravity that is different than the first specific gravity;

preparing a proppant mixture by mixing the first proppant material and the second proppant material, wherein preparing the proppant mixture comprises:

dynamically preparing the proppant mixture at a wellsite during preparation of a hydraulic fracturing fluid for a hydraulic fracturing operation; and adjusting a ratio of the first and second proppant materials in the proppant mixture based on the hydraulic fracturing operation;

preparing the hydraulic fracturing fluid comprising the proppant mixture;

adjusting the hydraulic fracturing fluid to a flow pattern operable to distribute a substantially equal distribution of an amount of proppant from the proppant mixture into a plurality of fracture clusters formed in a subterranean zone, wherein adjusting the hydraulic fracturing fluid comprises:

inducing a laminar flow regime in which proppant materials with lower specific gravities move toward an outer annulus of the flow pattern while proppant material with higher specific gravities move toward a center of the flow pattern; and distributing the hydraulic fracturing fluid for use in a multiple-stage fracturing treatment of the subterranean zone by distributing the hydraulic fracturing fluid in the substantially equal distribution of the amount of proppant from the proppant mixture into the plurality of fracture clusters, each of the plurality of fracture clusters formed in the subterranean zone at a unique depth from a terranean surface.

* * * * *